US005279533A

United States Patent [19]

Yin et al.

[11] Patent Number: 5,279,533

[45] Date of Patent: Jan. 18, 1994

[54] SWIVEL PLATFORM WITH DETACHABLE BACKREST AND RESILIENT EXERCISE CORDS

[76] Inventors: Sam Yin, No. 74, Lane 140, Sec. 2, Chung Hsing Rd., Hsin Tien, Taipei; Ming-Chih Huang, No. 33, Lane 1000, Chun Jih Rd., Tao Yuan, both of Taiwan

[21] Appl. No.: 959,798

[22] Filed: Oct. 13, 1992

[51] Int. Cl.[5] ..... A63B 22/14

[52] U.S. Cl. ..... 482/147; 482/140; 482/141; 482/142; 482/126; 482/123

[58] Field of Search ..... 482/146, 147, 140, 141, 482/142, 121, 122, 123, 126

[56] References Cited

U.S. PATENT DOCUMENTS 3,604,722 9/1971 Boley ..... 482/147
4,132,405 1/1979 Asher ..... 482/147
4,391,441 7/1983 Simjian ..... 482/147
4,687,198 8/1987 Smith ..... 482/147
5,141,483 8/1992 Smith ..... 482/142

*Primary Examiner*—Richard J. Apley
*Assistant Examiner*—Lynne A. Reichard
*Attorney, Agent, or Firm*—Jacobson, Price, Holman & Stern

[57] ABSTRACT

A fitness accessory includes a seat, a rotary table retained to the seat by a base plate, and a ball bearing retained between the seat and the rotary table, and a back plate detachable fastened to one side of the seat by dovetail joints. The seat has a pair of opposing hand grips when the appliance is used for push ups or sit ups. The rotary table has external raised portions for rubbing and kneading the feet when as the appliance is turned upside-down on the ground and stepped on. Elastic cords may be fastened to the base plate by plug members for pulling exercises.

12 Claims, 4 Drawing Sheets

SWIVEL PLATFORM WITH DETACHABLE BACKREST AND RESILIENT EXERCISE CORDS

BACKGROUND OF THE INVENTION

The present invention relates to an appliance for indoor gymnastics or a fitness accessory which comprises a seat having internally threaded bottom columns or fastener receiving apertures, a base plate fastened to the bottom columns or fastener receiving apertures of the seat by screws (i.e. fasteners) to hold a rotary table, and a ball bearing retained between the rotary table and the seat for permitting the seat and the base plate to be rotated relative to the rotary table. Therefore, either the top or the bottom of the appliance can be used for free gymnastics.

Various handy or portable appliances are known and widely used for indoor gymnastics. These appliances are commonly designed for a specific purpose. There is generally a twisting disk having an annular plate mounted on an inflated ball for jumping and twisting exercises. This twisting disk can not be used for push ups, sit ups or any other exercises. Universal gyms for body building are also known, which generally comprise an upright support on an I-shaped base frame to hold a chest-expander by an adjustable cross bar, a leg press, a thigh & knee machine, an abdominal board, a hip flexor and a shoulder press for training the muscles of different parts of the body. This type of universal gym is effective in use, however it is expensive to manufacture and difficult to assemble, and it needs a big installation space.

SUMMARY OF THE INVENTION

According to one aspect of the present invention, the fitness accessory comprises a seat having fastener receiving apertures, a base plate fastened to the seat by fastener screws to hold a rotary table, and a balls bearing having a plurality of rolling ball retained between an annular groove on an annular bottom projection on the seat and an annular groove on an annular top projection on the rotary table for permitting the seat and the base plate to be rotated relative to the rotary table.

According to another aspect of the present invention, the rotary table has a plurality of external raised portions for rubbing and kneading the muscles and joints of the legs and feet when the appliance is turned upside-down on the ground and stepped on.

According to still another aspect of the present invention, the base plate has a plurality of holes around a bottom edge thereof for fastening elastic cords for the pulling exercises, each elastic cord having one end coupled with a first plug member fastened to a plug hole on said base plate and an opposite end coupled with a second plug member fastened to a hand grip.

According to still another aspect of the present invention, the elastic cords may be detached from the base plate and connected between two hand grips, forming a chest-expander for exercising the muscles of the chest.

According to still another aspect of the present invention, a back plate attached to the seat assembly (which is formed of the seat, the base plate, the rotary table and the ball bearing) may be detached therefrom, thereby permitting the seat assembly to be lifted or swung in the hands for exercising the upper body.

DETAILED DESCRIPTION OF THE PREFERRED EMBODIMENT

Figures 1, 1A:
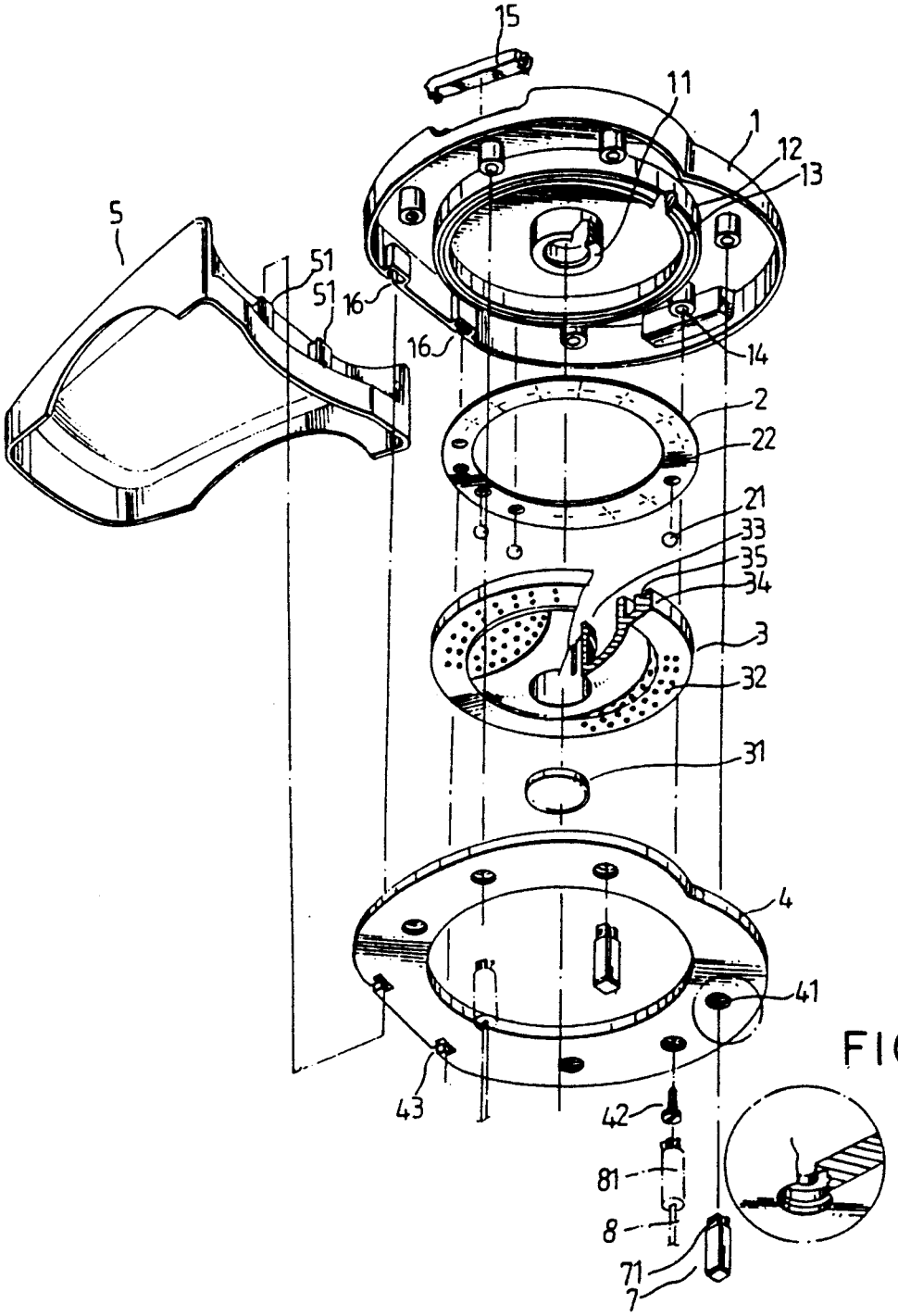
FIG. 1 is a perspective exploded view of the preferred embodiment of the present invention.
Figure 2:
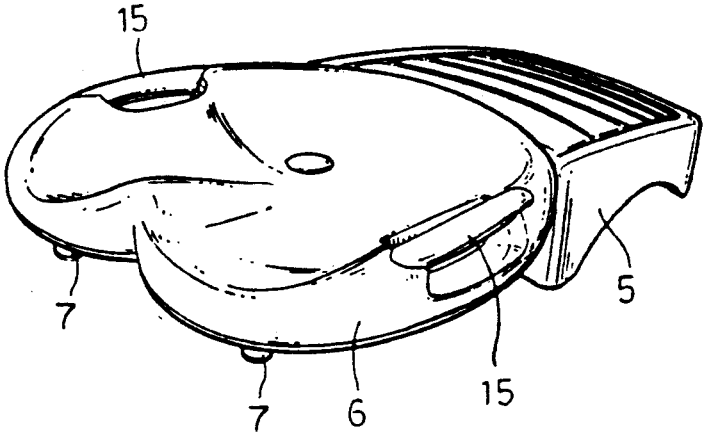
FIG. 2 is an elevational view of the assembled fitness accessory.

Referring to FIG. 1, the preferred embodiment of the present invention is generally comprised of a seat 1, an annular plate 2, a rotary table 3, a base plate 4, and a back plate 5. The seat 1 is orthopedically engineered to fit the shape of the hip to enable the user to sit comfortably thereon, having two grips 15 at opposing locations around the border or periphery thereof able to be gripped by each of the user's hands, a central stub bottom shaft 11, an annular groove 13 around the bottom surface provided in an annular bottom projection 12 surrounding the stub bottom shaft 11, a plurality of internally threaded columns 14 or fastener receiving apertures spaced around the annular bottom projection 12. The rotary table 3 has a central rubber pad 31 on a bottom surface thereof for supporting the device on the ground and preventing slip thereof, a plurality of small, circular, raised portions 32 covering the outside surface thereof, a central sleeve 33 into which the stub bottom shaft 11 of the seat 1 fits, and an annular groove 35 in the top edge of an annular top projection 34 thereof. The annular plate 2 is retained between the annular bottom projection 12 of the seat 1 and the rotary table 3, having a plurality of rolling balls 21 respectively received in equally spaced round holes 22 and revolvably fitted into the annular groove 13 in the annular bottom projection 12 of the seat 1 and the annular groove 35 on the annular top projection 34 of the rotary table 3. The base plate 4 is fastened to the seat 1 to hold the rotary table 3 and the annular plate 2 in place. By threading screws 42 (i.e. fasteners) through countersunk holes 41 on the base plate 4 into the internally threaded columns 14 on the seat 1, the base plate 4 and the seat 1 are fastened together to form a rotary seat assembly 6. The back plate 5 has dovetail tenons or protrusions 51 spaced on a rear edge thereof corresponding inserted through respective dovetail holes 43 in the base plate 4 and into respective dovetail holes 16 in the seat 1, therefore the back plate 5 is detachably secured to the rotary seat assembly 6. Projections (not shown) may be made on the dovetail tenons 51 and respectively engaged into recessed holes (not shown) inside the dovetail holes 43,16 to reinforce the connection.

Referring to FIG. 1 again, each countersunk hole 41 is comprised of a screw hole, into which a screw 42 is threaded, and a internally notched hole, into which either a plug member 71 on a stand 7 or a plug member 81 at an end of an elastic cord 8 may be fastened into the hole 41. By fastening stands 7 to the base plate 4, the base plate 4 is supported on the ground at the same level with the back plate 5. An elastic cord 8 according to the present invention has opposite ends each coupled with a respective plug member 81. By fastening one plug member 81 into a countersunk hole 41 on the base plate 4 and the other plug member 81 into a plug hole (not shown) on either end of a grip 9 (see FIG. 5), two grips 9 can be fastened to the base plate 4 by two pairs of elastic cords 8 for pulling exercises.

Figure 3:
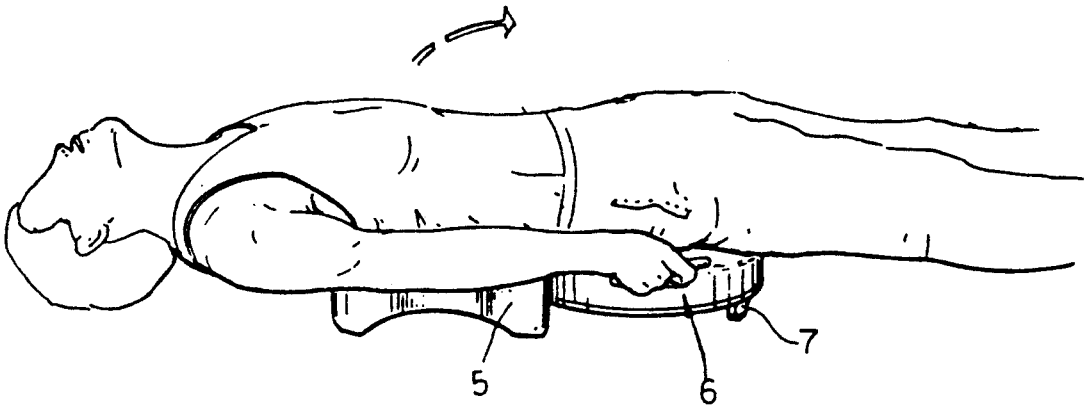
FIG. 3 illustrates an application of the present invention.

Referring to FIG. 3, the back plate 5 and the rotary seat assembly 6 are connected together, and the rotary seat assembly 6 is fastened with two stands 7 and supported on the ground. Then, the user can hold the two grips 15 of the seat 1 with their hands to perform push ups or sit ups.

Figure 4:
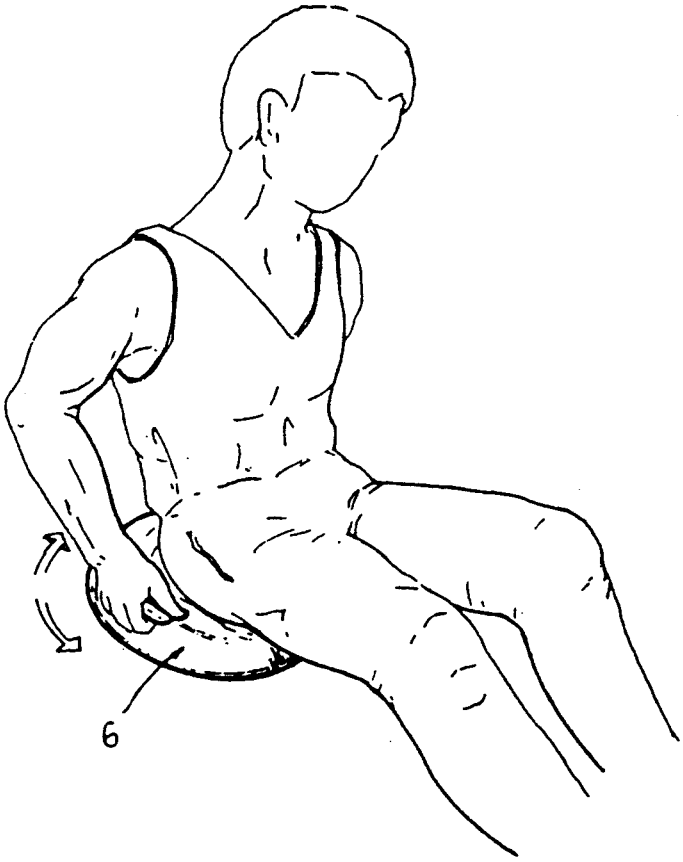
FIG. 4 illustrates another application of the present invention.
Figure 5:
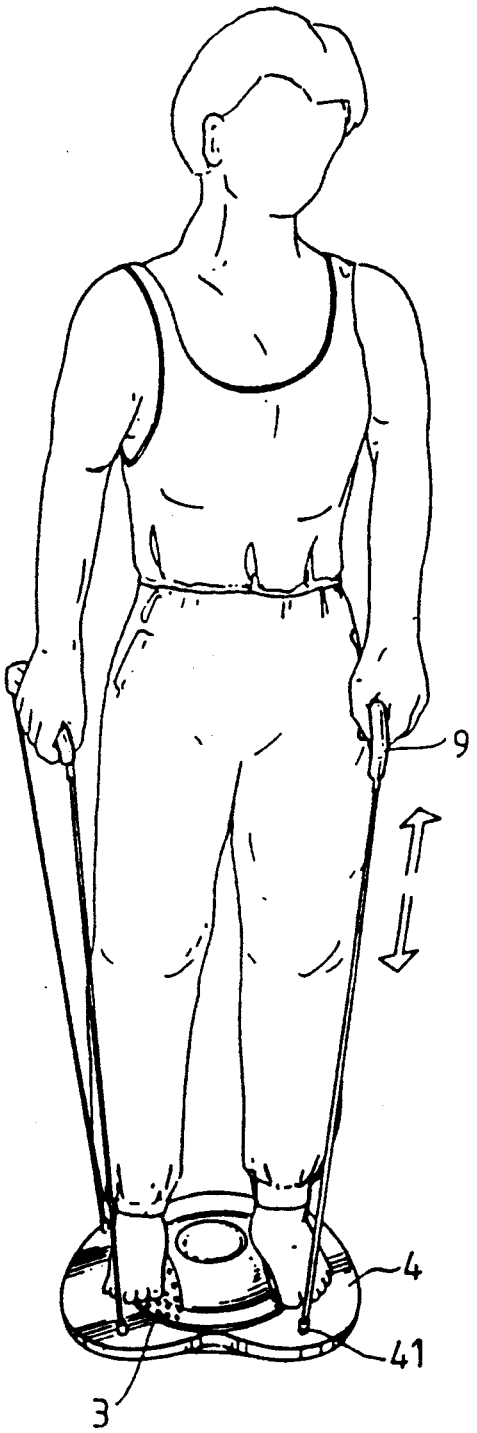
FIG. 5 illustrates still another application of the present invention.

Referring to FIGS. 4 and 5, the rotary seat assembly 6 may be detached from back plate 5 for separate use. The user may sit on the seat 1 with the grips 15 held in the hands and twist the waist (by means of the rotation of the rotary table 3). The rotary seat assembly 6 may be turned upside-down and placed on the ground so that the raised portions 32 of the rotary table 3 turn upward for the feet to step on and causing a rubbing and kneading effect on the feet to improve blood circulation.

Referring to FIG. 5 again, two grips 9 are fastened to the base plate 4 by two pairs elastic cords 8 and pulled upwardly with the hands while standing on the rotary table 3.

Furthermore, two elastic cords 8 may be connected between two grips 9 and used as a chest-expander for exercising the chest muscles. In addition, because the rotary seat assembly 6 is fairly heavy, it can be lifted or swung in the hands for exercising the arms and upper body.

As indicated, the present invention provides a fitness accessory which can be arranged in many ways for performing free gymnastics.

What is claimed is:

1. A readily portable, invertible, fitness accessory comprising:

a) a rotary seat assembly comprising i) a seat having a top surface shaped to fit the hips of a user of the accessory and a pair of hand grips provided at opposing locations at the periphery of the seat;

ii) a rotary table retained to said seat by a base plate, said rotary table having an external surface adapted for the user to stand and balance thereon;

iii) a ball bearing retained between said seat and said rotary table to enable rotation of the rotary table relative to the seat and base plate;

b) a pair of resilient members having attachment means to enable attachment thereof to the rotary seat assembly, the resilient members each having a hand grip at a free end thereof;

c) a back plate having attachment means to enable attachment to said rotary seat assembly, wherein;

d) said fitness accessory is able to be provided in a first, second and third configuration, in the first configuration, the seat is upwardly facing with the back plate attached to the rotary seat assembly to enable a user of the apparatus to do sit up and push up exercises, in the second configuration, the seat is upwardly facing and the back plate is detached from the rotary seat assembly so that the user can be seated on the seat and rotate the seat relative to the rotary member and in the third configuration, the external surface of the rotary table is upwardly facing and the resilient members are attached to the rotary seat assembly to enable the user to stand on the rotary table and rotate the rotary table relative to the base plate and the seat, holding the elastic members by the hand grips and optionally pulling the elastic members upwardly so as to exercise the arm muscles.

2. The fitness accessory of claim 1 having levelling means to stabilize the accessory when provided in the first configuration.

3. The fitness accessory of claim 2 wherein the levelling means comprises said back plate and two or more stands able to be fastened to the base plate.

4. The fitness accessory of claim 1 wherein the external surface of the rotary table has a plurality of small raised portions for massaging the user's feet.

5. The fitness accessory of claim 1 wherein each said resilient member comprises a pair of elastic cords, each cord having a first and second end, the first and second ends of the cords having an attachment member to enable attachment of the first end of the cord to the hand grip and attachment of the second end of the cord to an aperture in the base plate.

6. The fitness accessory of claim 5 wherein said elastic cords with attachment members are detachable from the base plate and can be connected between a pair of said hand grips, thereby forming a chest-expander.

7. The fitness accessory of claim 1 wherein the attachment means for the back plate comprises one or more tenons positioned on an edge thereof able to be inserted in corresponding holes in the base plate and in the seat.

8. The fitness accessory of claim 7 wherein each tenon also has a raised portion and the corresponding holes in the base plate and the seat have corresponding recesses to attach the back plate more securely to the rotary seat assembly.

9. The fitness accessory of claim 1 wherein the seat has an stub bottom shaft which sits in a center sleeve of the rotary member.

10. The fitness accessory of claim 1 wherein the rotary table has a central rubber pad for preventing the fitness accessory slipping when the external surface of the rotary table is placed on a surface.

11. The fitness accessory of claim 1 wherein said seat has a plurality of internal fastener-receiving columns and said base plate has a plurality of fastener-receiving apertures to enable attachment of the base plate to the seat by a plurality of fasteners to retain the rotary table therebetween.

12. The fitness accessory of claim 1 wherein the ball bearing comprises a plurality of balls in a plurality of holes in an annular plate, said balls retained in an annular groove provided in an annular bottom projection of said seat and an annular groove provided in an annular top projection of said rotary table.

* * * * *